US011365079B2

(12) United States Patent
Johnson et al.

(10) Patent No.: US 11,365,079 B2
(45) Date of Patent: Jun. 21, 2022

(54) PRINTER FINISHING APPARATUS

(71) Applicant: HEWLETT-PACKARD DEVELOPMENT COMPANY, L.P., Spring, TX (US)

(72) Inventors: Bruce G. Johnson, Vancouver, WA (US); Robert Yraceburu, Vancouver, WA (US); Wesley R. Schalk, Vancouver, WA (US); Luke P. Sosnowski, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,392

(22) PCT Filed: Jul. 19, 2018

(86) PCT No.: PCT/US2018/042841
§ 371 (c)(1),
(2) Date: Oct. 2, 2019

(87) PCT Pub. No.: WO2020/018102
PCT Pub. Date: Jan. 23, 2020

(65) Prior Publication Data

US 2021/0331885 A1 Oct. 28, 2021

(51) Int. Cl.
*B65H 31/26* (2006.01)
*B65H 29/04* (2006.01)
*B65H 31/36* (2006.01)

(52) U.S. Cl.
CPC ..... *B65H 29/041* (2013.01); *B65H 31/26* (2013.01); *B65H 31/36* (2013.01);
(Continued)

(58) Field of Classification Search
CPC ..... B65H 29/041; B65H 31/36; B65H 31/26; B65H 2301/4212; B65H 2801/27; B65H 2701/1311
See application file for complete search history.

(56) References Cited

U.S. PATENT DOCUMENTS 6,241,234 B1 * 6/2001 Saitoh ..... B65H 31/3027 270/58.12
6,311,971 B1 * 11/2001 Greer ..... B65H 29/22 270/58.08

(Continued)

FOREIGN PATENT DOCUMENTS

WO WO2017099748 A1 6/2017

OTHER PUBLICATIONS

High productivity and versality in a professional production machine, Konica Minolta, Inc.
High-volume performance with superior quality and value, Lanier.

*Primary Examiner* — Patrick H Mackey
(74) *Attorney, Agent, or Firm* — Dicke Billig & Czaja PLLC

(57) ABSTRACT

Example printer finishing apparatus are described herein. An example printer disclosed herein includes an alignment guide, a track to align a sheet relative to the alignment guide, a clamp to move between a raised position and a lowered position relative to the sheet, and a force applicator coupled to the clamp. The force applicator is to cause the sheet to engage the alignment guide when the clamp is in the lowered position.

15 Claims, 11 Drawing Sheets

(52) U.S. Cl.
CPC ..... *B65H 2301/4212* (2013.01); *B65H 2404/1114* (2013.01); *B65H 2701/1311* (2013.01); *B65H 2801/27* (2013.01)

(56) References Cited

U.S. PATENT DOCUMENTS

| | | | | |
|---|---|---|---|---|
| 7,475,874 | B2 * | 1/2009 | Sato | B65H 29/001 270/58.09 |
| 7,845,634 | B2 * | 12/2010 | Asakawa | B65H 29/58 271/207 |
| 8,123,209 | B2 * | 2/2012 | Kubota | B65H 37/04 270/58.07 |
| 2002/0097317 | A1 | 7/2002 | Wood et al. | |
| 2005/0023742 | A1 | 2/2005 | Tamura et al. | |
| 2008/0213017 | A1 * | 9/2008 | Morisawa | B65H 29/52 399/405 |
| 2010/0084806 | A1 | 4/2010 | Masuda | |

* cited by examiner

PRINTER FINISHING APPARATUS

BACKGROUND

After a sheet is printed with content using a printer, the sheet is delivered to a finisher of the printer. When the sheet reaches the finisher, the sheet may undergo a page registration process to align the sheet with other sheets in preparation for finishing operations such as stapling.

Figure 1:
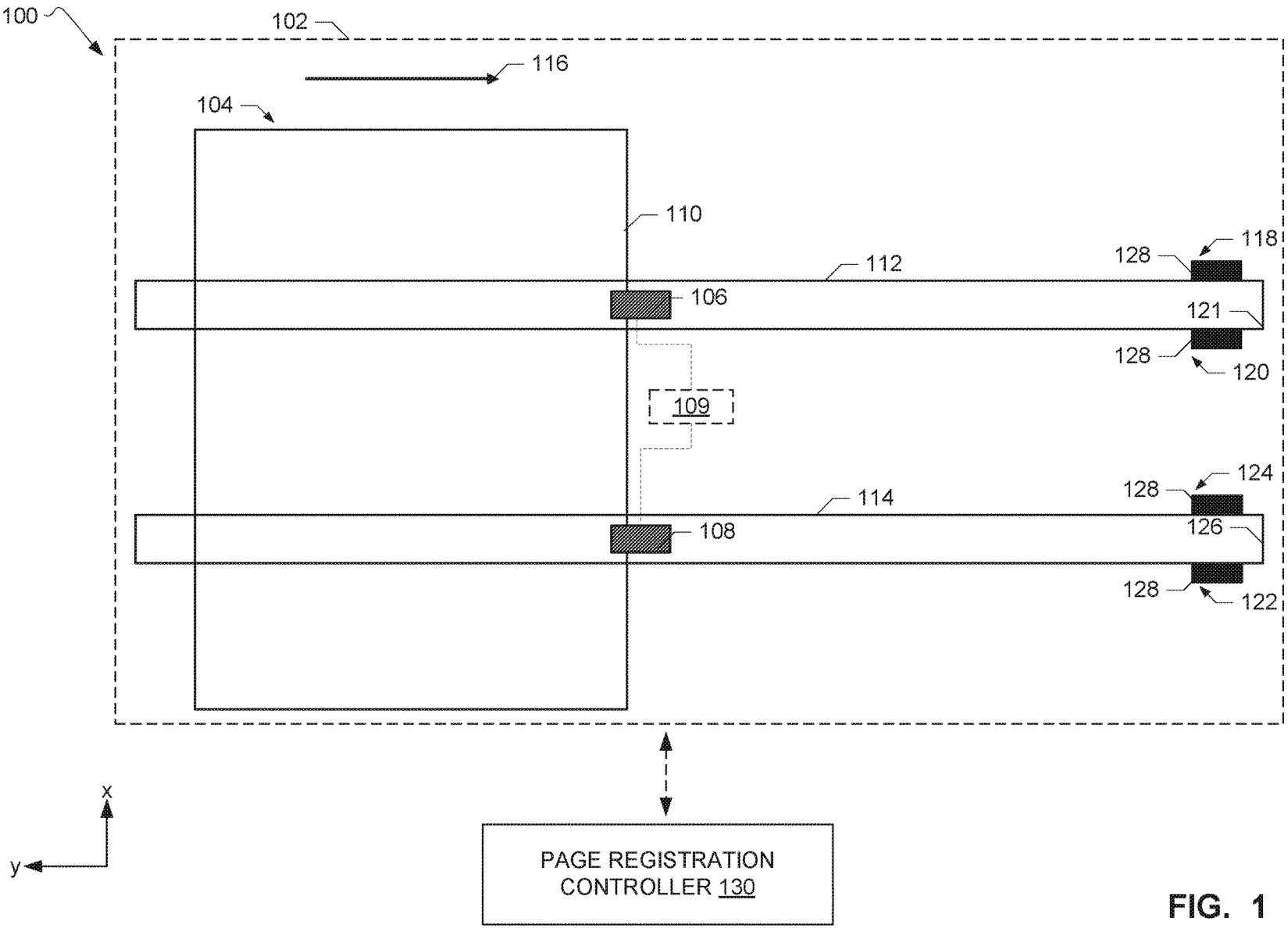
FIG. 1 illustrates an example system including a finisher for page registration in accordance with teachings of this disclosure.

The figures are not to scale. Wherever possible, the same reference numbers will be used throughout the drawings and accompanying written description to refer to the same or like parts. While the drawings illustrate examples of printers, other examples may be employed to implement the examples disclosed herein.

DETAILED DESCRIPTION

Disclosed herein are example printer finishing apparatus including a sheet clamp having a force applicator coupled thereto. In examples disclosed herein, the force applicator of the sheet clamp actively registers or aligns a sheet relative to alignment guides of a printer finisher tray to prevent and/or correct any misalignment of the sheet that may occur when the sheet clamp engages the sheet. Registration of a sheet includes correcting alignment or skew of a sheet by moving the sheet in an x-direction and/or a y-direction. In some examples disclosed herein, a sheet undergoes a two-stage registration process that prevents or substantially reduces sheet misalignment when two or more sheets are accumulated in a stack for finishing operations such as stapling and/or booklet making. In some examples disclosed herein, a sheet clamp, also referred to herein as a leading edge clamp, of a printer finisher includes a force applicator (e.g., a roller, a mechanical finger, a flap) to move (e.g., advance) or hold the sheet against the alignment guides. The advancement of the sheet against the alignment guides via the force applicator addresses instances of misalignment that can occur after the sheet has undergone an initial registration process and the leading edge clamp clamps the sheet to the stack.

In some known finishers, after printing, a sheet is gripped by puller clamps and moved (e.g., in an x- and/or y-direction) via rotatable tracks to align a leading edge of the sheet relative to alignment guides. After the sheet contacts the alignment guides, the puller clamps release the sheet and a leading edge clamp is lowered (e.g., in the z-direction) onto the sheet to clamp the sheet to a stack of previously accumulated sheets. However, when the puller clamps release the sheet, the leading edge of sheet is no longer controlled by the puller clamps. As such, the engagement of the leading edge clamp with the sheet can cause translation or skew of the sheet after the sheet has been aligned. Thus, in known finishers, residual sheet misalignment can occur despite page registration efforts prior to the clamping of the sheet via the leading edge clamp. However, prior art finishers do not address this residual sheet misalignment.

Some known finishers include tappers, or devices to tap the sides of sheet to move and align the sheet. However, sheets printed using inkjet printers have a higher sheet-to-sheet friction, a lower stiffness, and/or a higher degree of curl/cockle as compared to unprinted sheets or laser-printed sheets. As a result, tapping the sides of an inkjet-printed sheet to move the sheet into alignment can result in buckling of sheet and/or dragging of a previously accumulated sheet due to friction.

Disclosed herein are example finishers including a leading edge clamp having a force applicator coupled thereto. The force applicator can include, for example, a motor-driven roller. In some examples disclosed herein, when the leading edge clamp is lowered, the roller is rotated to exert a force on the sheet to advance (e.g., push, pull) the sheet against the alignment guides. Thus, examples disclosed herein minimize residual sheet misalignment and provide for improved page registration by maintaining the alignment of the sheet with the alignment guides and/or causing the sheet to re-engage the alignment guides.

In some examples disclosed herein, the force applicator includes a roller. In some other examples, the force applicator includes a shaft having a projection extending therefrom. In examples disclosed herein, a portion of the force applicator engages a portion of the sheet (e.g., a top surface of the sheet) and exerts a force on the sheet. The application of force on the sheet advances (e.g., pushes or pulls) the sheet against the alignment guides of the finisher so that the sheet remains registered against the alignment guides during movement of the leading edge clamp.

In some examples disclosed herein, a processor is communicatively coupled to the force applicator. The processor controls operation of the force applicator based on rules (e.g., user defined rules). The rules can define operational variables of the force applicator such as a time at which the force applicator is to be activated with respect to movement (e.g., opening or closing) of the leading edge clamp, a number of rotations completed by the force applicator (e.g., by a roller, by a shaft including projections) per sheet, a speed of rotation, and a duration of rotation of force applicator. In some examples, operational variables are based on factors such as an amount of ink on the sheet.

FIG. 1 illustrates an example system 100 including a finisher 102 for registration of a sheet 104 (e.g., a paper sheet) after the sheet 104 is printed. The finisher 102 can be installed in a printer, such as an inkjet printer or a laser printer. For illustrative purposes, a top view of the example finisher 102 is shown in FIG. 1. The finisher 102 may be disposed in a substantially horizontal position relative to the printer (e.g., with little or no sloping). In the example of FIG. 1, the sheet 104 is to be accumulated in a stack of other sheets in the finisher 102 to undergo finishing operations such as stapling and/or booklet making. In other examples, the sheet 104 is the first sheet of a stack of sheets to be compiled.

In the example of FIG. 1, the sheet is 104 is held by (e.g., gripped by) a first puller clamp 106 and a second puller clamp 108. The first and second puller clamps 106, 108 engage a first or leading edge 110 of the sheet 104. In the example of FIG. 1, the first and second puller clamps 106, 108 pull the sheet 104 along respective first and second tracks 112, 114 in a y-direction, as represented by arrow 116 of FIG. 1. The puller clamps 106, 108 are operatively coupled to a puller clamp drive mechanism 109 (e.g., a motor) that move the puller clamps 106, 108.

The puller clamps 106, 108 transport the sheet 104 along the tracks 112, 114 toward alignment guides of the finisher 102, which facilitate alignment or registration of the sheet 104. The example finisher 102 of FIG. 1 includes a first alignment guide 118 and a second alignment guide 120 coupled to an end 121 of the first track 112. The example finisher 102 of FIG. 1 includes a third alignment guide 122 and a fourth alignment guide 124 coupled to an end 126 of the second track 114. As disclosed herein, during alignment of the sheet 104, the leading edge 110 of the sheet 104 engages a surface or wall 128 of the first, second, third, and/or fourth alignment guides 118, 120, 122, 124. The example finisher 102 can include additional or fewer puller clamps, tracks, and/or alignment guides than illustrated in FIG. 1.

In the example of FIG. 1, the puller clamps 106, 108 and the tracks 112, 114 are operatively controlled by a page registration controller 130. The page registration controller 130 controls, for instance, the clamping of the sheet 104 by the first and second puller clamps 106, 108 and the movement of the puller clamps 106, 108 along the tracks 112, 114. As disclosed herein, the page registration controller 130 controls a position of the tracks 112, 114 during alignment of the sheet 104.

Figure 2:
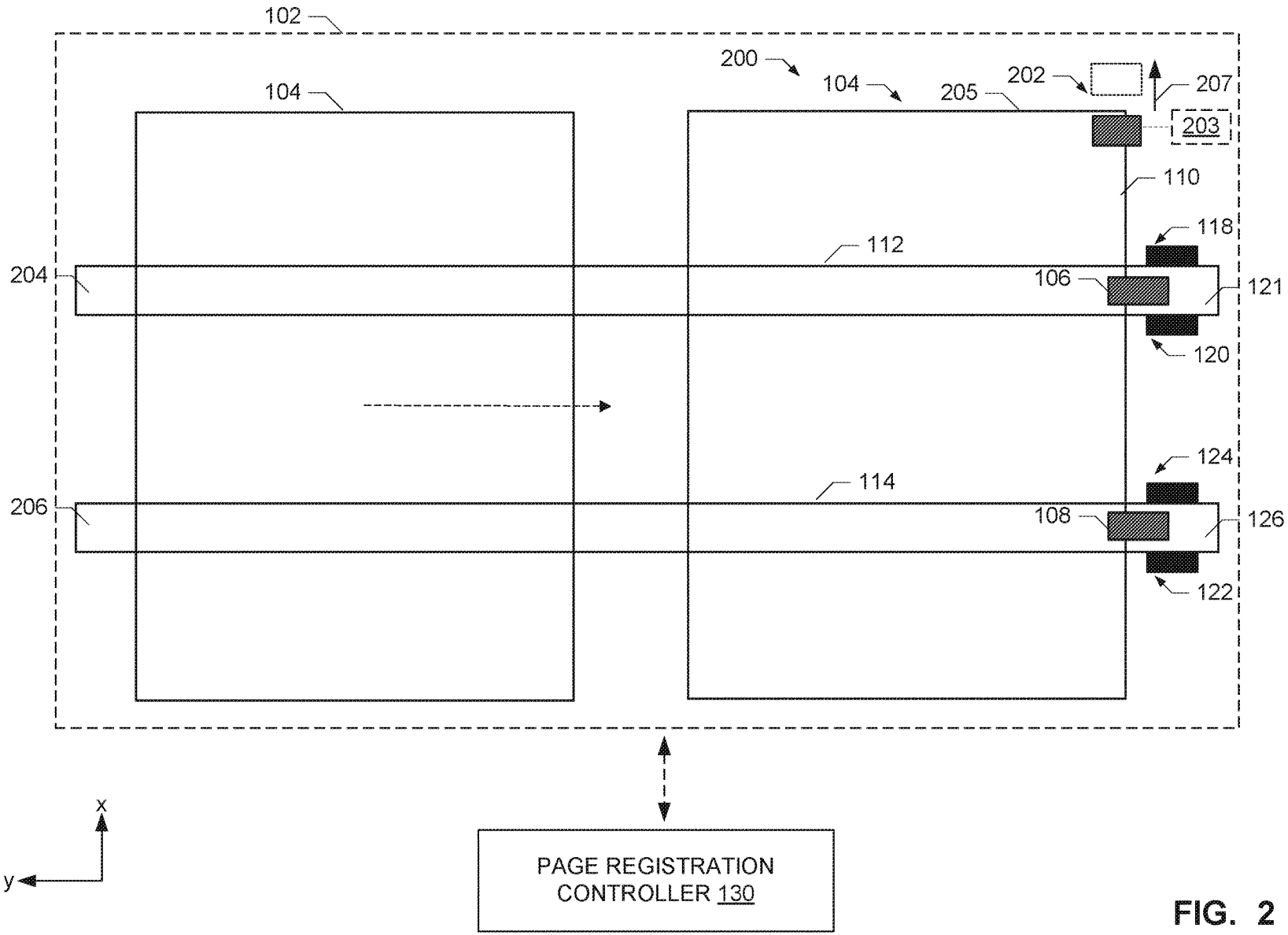
FIGS. 2-6 illustrate the example finisher of FIG. 1 and, in particular, illustrate registration of a sheet via the finisher in accordance with teachings disclosed herein.

FIG. 2 is another view of the example finisher 102 of FIG. 1 and, in particular, illustrates movement of the sheet 104 from a first position (e.g., as shown in FIG. 1) to a second position via the first and second puller clamps 106, 108 and the tracks 112, 114. As illustrated in FIG. 2, upon receipt of sheet 104 in the finisher 102, the puller clamps 106, 108 move the sheet 104 to an alignment region 200 of the tracks 112, 114. The alignment region 200 of the finisher 102 includes a sensor 202. In the example of FIG. 2, the sensor 202 is operatively coupled to a sensor drive mechanism 203 (e.g., a motor) that moves the sensor 202. The sensor 202 can be a position sensor and/or another type of sensor configured to detect or locate the leading edge 110 of the sheet 104 (e.g., in the y-direction) and/or a side edge 205 of sheet 104 (e.g., in the x-direction). The data generated by the sensor 202 is transmitted to the page registration controller 130 via wired and/or wireless communication protocols. The example finisher 102 can include additional sensors to detect the leading edge 110 of the sheet 104.

Based on the sensor data, the page registration controller 130 determines a distance that the sheet 104 should be translated in the x-direction and/or the y-direction to align the sheet 104 with previously accumulated sheets. As the sheet 104 enters a sensing range of the sensor 202, the sensor 202 locates the leading edge 110 of the sheet 104. In the example of FIG. 2, the page registration controller 130 instructs the sensor drive mechanism 203 to move the sensor 202 to locate the side edge 205 of the sheet 104 to determine the amount of distance of the sheet should be moved in the x-direction, as represented by arrow 207 of FIG. 2. In other examples, the sensor 202 is stationary and the sheet is moved in the x-direction via a drive mechanism.

To facilitate the alignment, the page registration controller 130 generates an instruction directing the first track 112 to rotate about an end 204 of the first track 112 opposite the end 121 to which the first and second alignment guides 118, 120 are coupled and/or directing the second track 114 to rotate about an end 206 of the second track 114 opposite the end 126 to which the third and fourth alignment guides 122, 124 are coupled.

Figure 3:
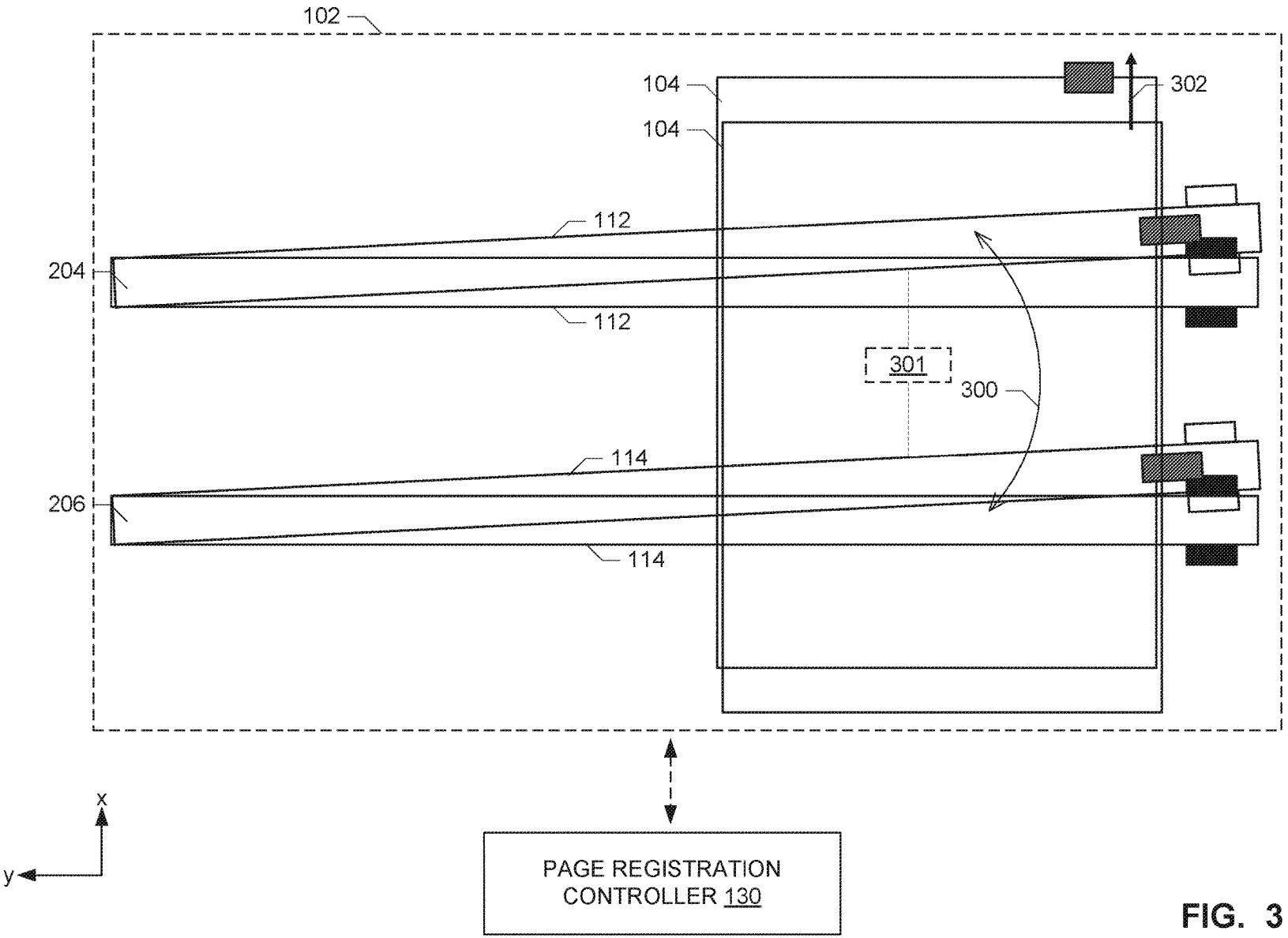

FIG. 3 is another view of the example finisher 102 of FIG. 1 and, in particular, illustrates translation of the sheet 104 via rotation of the first and/or second tracks 112, 114 about the respective ends 204, 206 (e.g., about mechanical pivots to which the ends 204, 206 to which the tracks 112, 114 are coupled), as represented by arrow 300 of FIG. 3. In some other examples, the tracks 112, 114 are translated in the x-direction. The tracks 112, 114 are operatively coupled to a track drive mechanism 301 (e.g., a motor) that cause the tracks 112, 114 to rotate.

In some examples, rotation of the tracks 112, 114 causes translation of the sheet 104 in the x-direction, as represented by arrow 302 of FIG. 3. In some examples, the sheet 104 is additionally or alternatively translated in the y-direction as a result of the rotation of the tracks 112, 114. In some examples, an amount the sheet 104 is translated in the x-direction via rotation of the tracks 112, 114 is greater than an amount the sheet 104 is translated in the y-direction.

Figure 4:
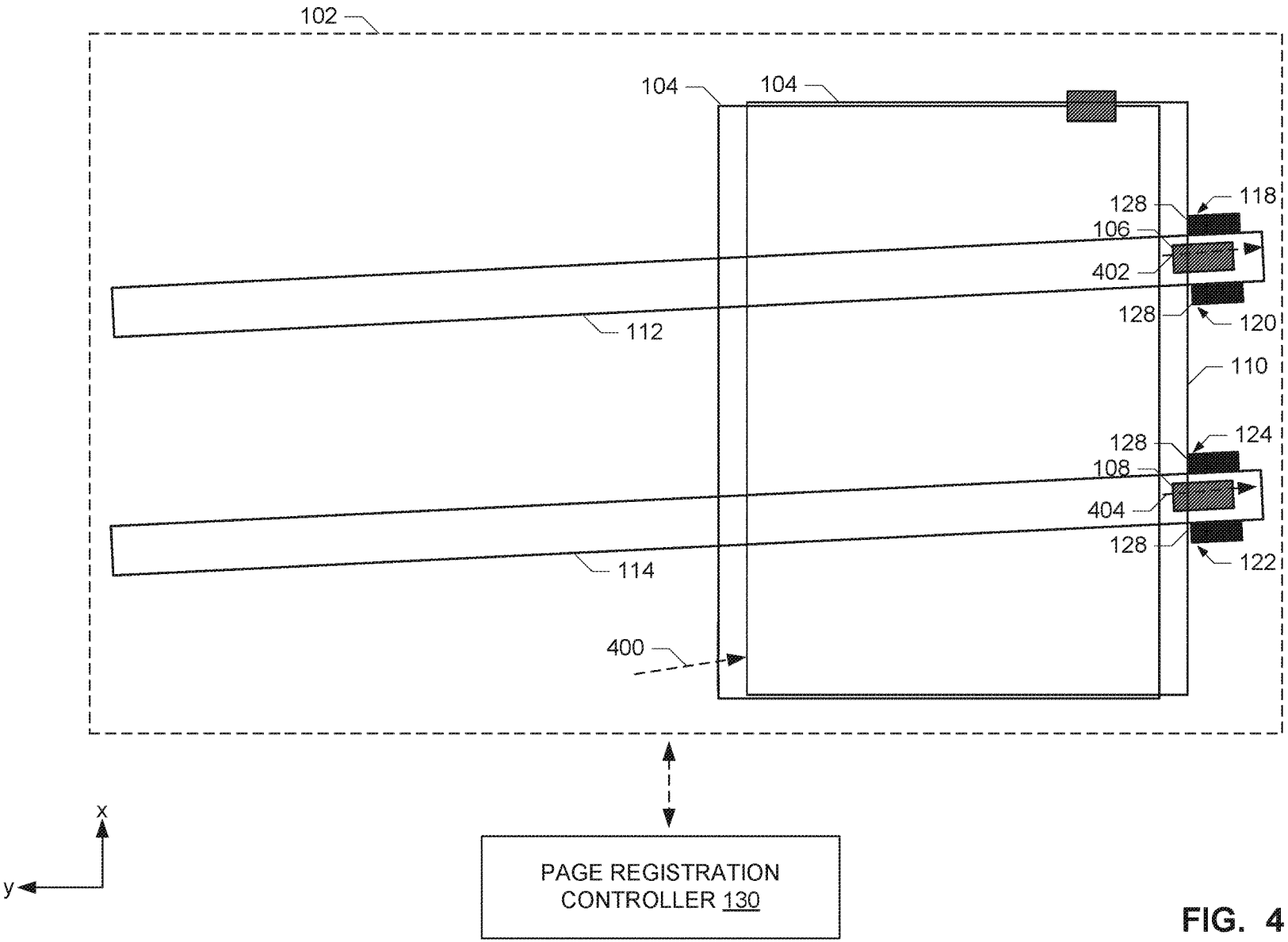

FIG. 4 is another view of the example finisher 102 of FIG. 1 and, in particular, illustrates the alignment of the sheet 104 relative to the alignment guides 118, 120, 122, 124. In the example of FIG. 4, the page registration controller 130 instructs the puller clamps 106, 108 to pull the leading edge 110 of the sheet 104 along the tracks 112, 114 (e.g., the rotated tracks) to make contact with the respective surfaces 128 of the alignment guides 118, 120, 122, 124. The puller clamps 106, 108 pull the leading edge 110 of the sheet 104 toward the alignment guides 118, 120, 122, 124 in the y-direction, as represented by arrow 400 of FIG. 4. As represented by arrows 402, 404 of FIG. 4, the puller clamps 106, 108 move past the surfaces 128 of the alignment guides 118, 120, 122, 124 as the puller clamps 106, 108 bring the leading edge 110 of the sheet 104 into engagement with the alignment guides 118, 120, 122, 124. In some examples, the leading edge 110 of the sheet 104 only engages some of the alignment guides 118, 120, 122, 124 (e.g., one, two, or three of the alignment guides).

When the leading edge 110 of the sheet 104 engages the surfaces 128 of alignment guides 118, 120, 122, 124, any angular misalignment or skew of the sheet 104 (e.g., relative to previously accumulated sheets) is removed or substantially removed. In some examples, the sheet 104 is released from (e.g., pushed out of) the puller clamps 106, 108 by the surfaces 128 of the alignment guides 118, 120, 122, 124 (e.g., prior to the opening of the puller clamps 106, 108). In some examples, the puller clamps 106, 108 release the leading edge 110 of the sheet 104 via mechanical components of the tracks 112, 114 that trigger the puller clamps 106, 108 to release the sheet 104. For example, the tracks 112, 114 can include respective triggers that contact or otherwise actuate respective latches of the puller clamps 106, 108 to facilitate release of the sheet 104 from the puller clamps 106 108. In some examples, the page registration controller 130 instructs the puller clamps 106, 108 to release the leading edge 110 of the sheet 104. In some examples, the page registration controller 130 instructs the puller clamps 106, 108 to release the leading edge 110 based on sensor data generated by sensors associated with the puller clamps 106, 108 and/or the alignment guides 118, 120, 122, 124. For instance, sensor associated with the puller clamps 106, 108 can generate data indicative of a position of the puller clamps 106, 108 relative to the surfaces 128 of the alignment guides 118, 120, 122, 124. In some other examples, the alignment guides 118, 120, 122, 124 include respective sensors to detect contact between the surfaces 128 of the alignment guides 118, 120, 122, 124 and the leading edge 110 of the sheet 104. The example puller clamps 106, 108 includes rollers that enable the puller clamps 106, 108 to roll off of the sheet 104 when the sheet 104 contacts the surfaces 128 of the alignment guides 118,120, 122, 124 without deforming or otherwise damaging the sheet 104. In some examples, the puller clamps 106, 108 move further along the tracks 112, 114 in the direction of arrows 402, 404 when the puller clamps 106, 108 release the sheet 104 to reduce interference with the aligned sheet 104. Thus, registration of the sheet 104 includes translation of the sheet 104 in the x- and y-directions via movement of the puller clamps 106, 108 and the tracks 112, 114.

Figure 5:
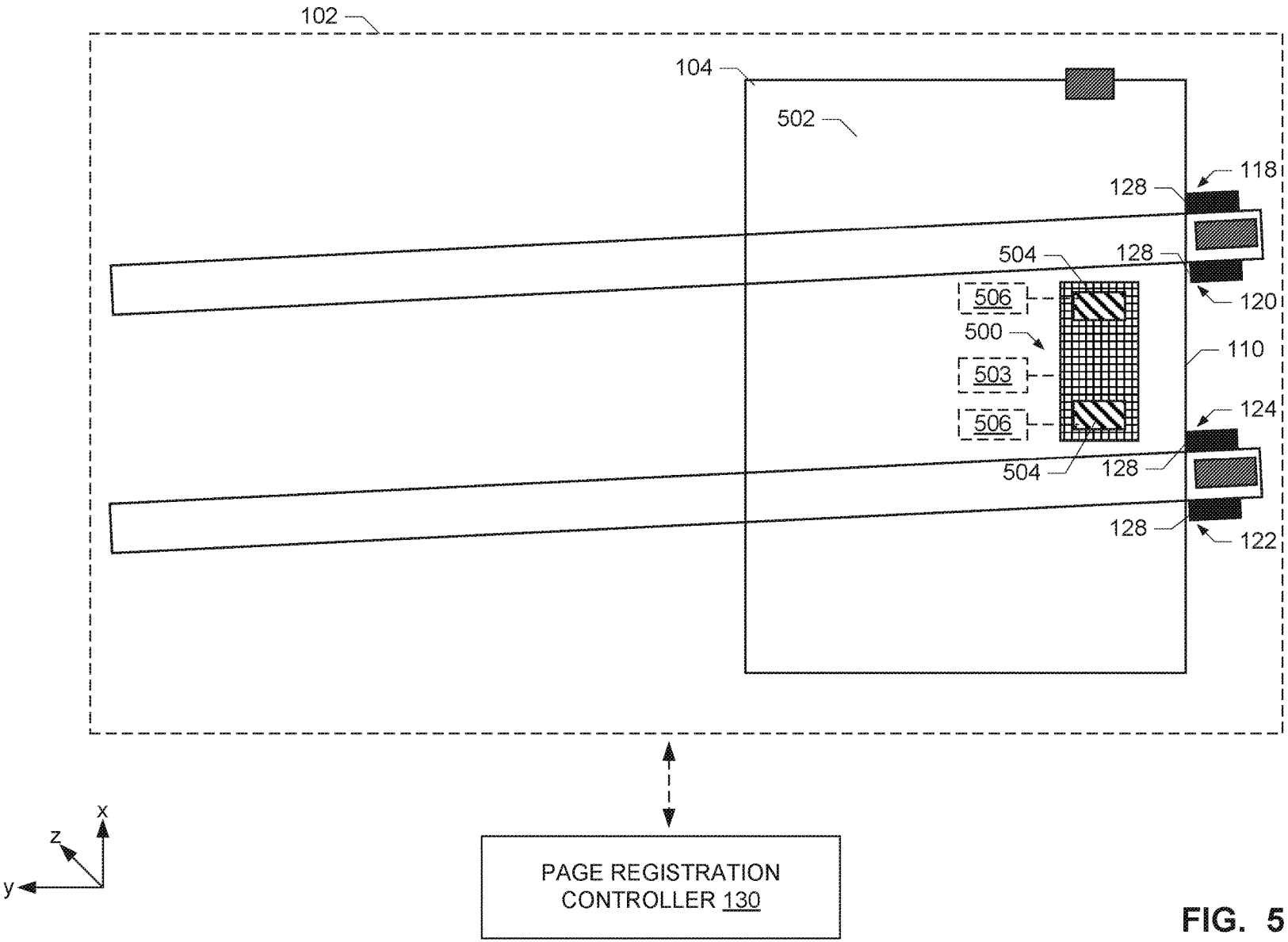

After the sheet 104 is aligned or registered via the puller clamps 106, 108 and the tracks 112, 114, the example finisher 102 clamps the sheet 104 to previously accumulated sheets in the finisher 102. FIG. 5 is another view of the example finisher 102 including a leading edge clamp 500 to clamp the sheet 104 to the previously accumulated sheets after the sheet 104 has been aligned as discussed above in connection with FIGS. 1-4. As discussed herein, the leading edge clamp 500 is moveably coupled to a housing of the finisher 102. During the alignment of the sheet 104 discussed in connection with FIGS. 1-4, the leading edge clamp 500 of FIG. 5 is disposed in a raised position relative to the sheet 104. After the sheet 104 has been aligned, the page registration controller 130 instructs the clamps, including the leading edge clamp 500 to move from the raised position to a lowered position to engage a surface 502 of the sheet 104, thereby clamping the sheet 104 to the previously accumulated sheets. The leading edge clamp 500 moves toward the surface 502 of the sheet 104 (i.e., downward the z-direction relative to the surface 502 of the sheet 104). After the leading edge clamp 500 clamps the sheet 104 to the previously accumulated sheets, the page registration controller 130 instructs the leading edge clamp 500 to hold the sheet 104 in a clamped position until the leading edge clamp 500 is to be moved to allow accumulation of the next sheet. In some examples, the leading edge clamp 500 remains in the lowered position until registration of the new sheet is completed in the x-direction. Holding of the sheet 104 in the clamped position via the leading edge clamp 500 prevents and/or reduces curl of the leading edge 110 of the sheet 104. When the next sheet is to be added to the stack, the page registration controller 130 instructs the leading edge clamp 500 to move away from the sheet 104 (e.g., upward in the z-direction relative to the surface 502 of the sheet 104). The up-and-down movement of the leading edge clamp 500 accommodates accumulation of additional sheets to the stack including the sheet 104. Movement of the leading edge clamp 500 is operatively controlled by a leading edge clamp drive mechanism 503 (e.g., a motor).

The example leading edge clamp 500 includes force applicators 504 coupled thereto. In the example of FIG. 5, the force applicators 504 are coupled to the leading edge clamp 500 so as to engage the surface 502 of the sheet 104 when the leading edge clamp 500 is in the lowered position. The force applicators 504 can include for example, wheels, rollers, a shaft having projections coupled thereto, or other means for exerting a force on the surface 502 of the sheet 104 to advance the sheet 104 to ensure or substantially ensure that the leading edge 110 of the sheet 104 remains in contact with the surfaces 128 of the alignment guides 118, 120, 122, 124. In examples in which the force applicators 504 include rollers, the rollers may be substantially circular or can include both circular surface and substantially flat surface (e.g., a D-shaped roller). The force applicators 504 are operatively controlled by a force applicator drive mechanism 506 (e.g., a motor). Although the example of FIG. 5 shows two force applicators 504, the leading edge clamp 500 can include additional or fewer force applicators (e.g., one force applicator, four force applicators). In some examples, one force applicator drive mechanism 506 controls the force applicators 504. In other examples, each force applicator 504 is controlled by a respective force applicator drive mechanism 506.

In the example of FIG. 5, when the leading edge clamp 500 moves toward the surface 502 of the sheet 104, the force applicators 504 engage the surface 502 of the sheet 104. The page registration controller 130 activates the force applicators 504 to cause the force applicators 504 to move to advance and/or hold the leading edge 110 of the sheet 104 against the surfaces 128 of the alignment guides 118, 120, 122, 124. The movement of the force applicators 504 can include rotation of the force applicators 504. As a result of the movement of the force applicators 504, any misalignment or skew of the sheet 104 that can occur during clamping of the sheet 104 by the leading edge clamp 500 is prevented or substantially reduced. Thus, the alignment of the sheet relative to the alignment guides 118, 120, 122, 124 is maintained. In some examples, the movement of the force applicators 504 corrects the alignment of the sheet 104 if any misalignment has occurred due to the engagement of leading edge clamp 500 with the sheet 104. In such examples, the force applicators 504 cause the sheet 104 to re-engage or contact the alignment guides 118, 120, 122, 124. The example force applicators 504 may remain activated until, for instance, the leading edge clamp 500 returns to the raised position (i.e., moves away from the surface 502 of the sheet 104). In some examples, the force applicators 504 remain active or are activated as the leading edge clamp 500 moves to the raised position.

The example leading edge clamp 500 can include fewer or additional force applicators 504 than illustrated in FIG. 5. For example, the force applicator 504 can include one roller extending along a portion of a length of the leading edge clamp 500. In other examples, the leading edge clamp 500 includes two or more of force applicators 504 disposed along a length of the leading edge clamp 500. The location, size, and/or shape of the force applicators 504 can differ from the examples shown herein.

Figure 6:
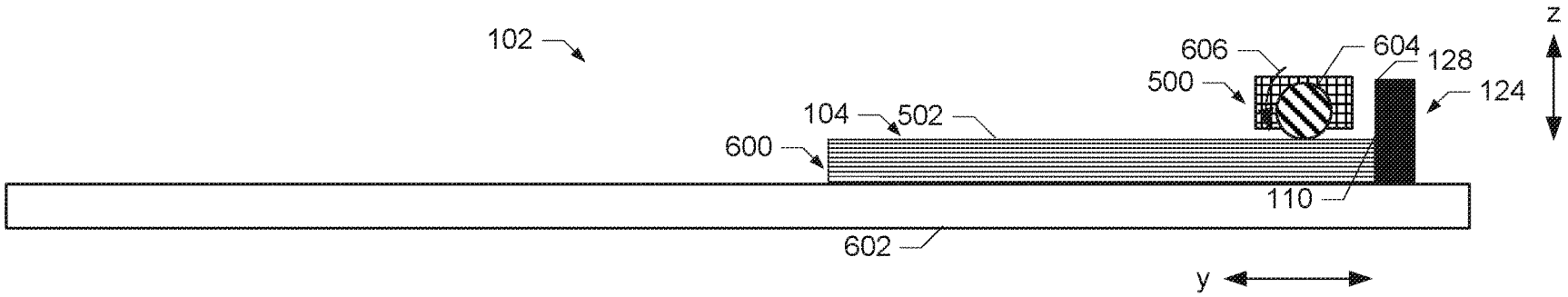

FIG. 6 is a side view of the example finisher 102 and illustrates the leading edge clamp 500 in the lowered position relative to the surface 502 of the sheet 104. As illustrated in FIG. 6, in the lowered position, the leading edge clamp 500 engages the surface 502 of the sheet 104 to clamp the sheet 104 to a stack 600 of previously accumulated sheets in the finisher 102. The stack 600 rests on a tray 602 of the finisher 102 during the accumulation of sheets to the stack 600.

For illustrative purposes, a cross-sectional view of the leading edge clamp 500 is shown in FIG. 6. The example leading edge clamp 500 of FIG. 6 includes a force applicator 604. In the example of FIG. 6, the force applicator 604 is a roller. In some examples, the leading edge clamp 500 includes one roller. In other examples, the leading edge clamp 500 includes two or more rollers spaced apart from one another (e.g., as shown in the example of FIG. 5). The force applicator 604 can have a different shape and/or size than shown in FIG. 6.

In the example of FIG. 6, when the leading edge clamp 500 is in the lowered position, the force applicator 604 rotates in a direction represented by arrow 606 of FIG. 6 (e.g., a counter-clockwise direction) to move or hold the sheet 104 against the surfaces 128 of the alignment guides 118, 120, 122, 124. The rotation of the force applicator 604 or roller can be controlled by a motor associated with the force applicator 604 (e.g., the drive mechanism 506 of FIG. 5) and the page registration controller 130 (FIGS. 1-5). For example purposes, FIG. 6 shows the fourth alignment guide 124, however, the force applicator 604 can facilitate alignment of the leading edge 110 of the sheet 104 relative to any of the other alignment guides 118, 120, 122, 124 to prevent or correct skewing of the sheet 104 when the leading edge clamp 500 engages the sheet 104.

Figure 7:
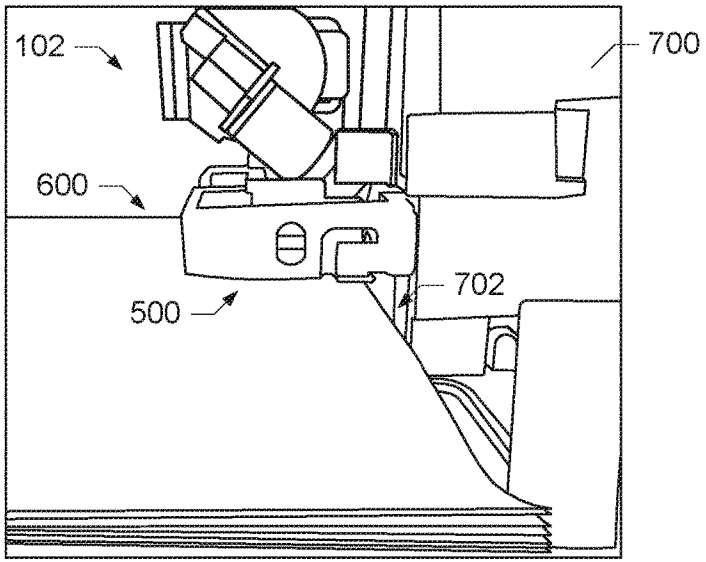
FIG. 7 is a partial, side perspective view of the example finisher of FIGS. 1-6.

FIG. 7 is a side, perspective view of a portion of the example finisher 102 of FIGS. 1-6. As shown in FIG. 7, the leading edge clamp 500 is coupled to a housing 700 of the finisher 102. The housing 700 includes a track 702. The track 702 provides a pathway for the leading edge clamp 500 to travel (e.g., in the z-direction) between the raised and lowered positions relative to the sheet stack 600. The example finisher 102 includes a motor disposed in the housing 700 (e.g., the leading edge clamp drive mechanism 503 of FIG. 5) to control the position of the leading edge clamp 500 along the track 702 relative to the stack 600. The housing 700 can include additional tracks 702 for the leading edge clamp 500.

Figure 8:
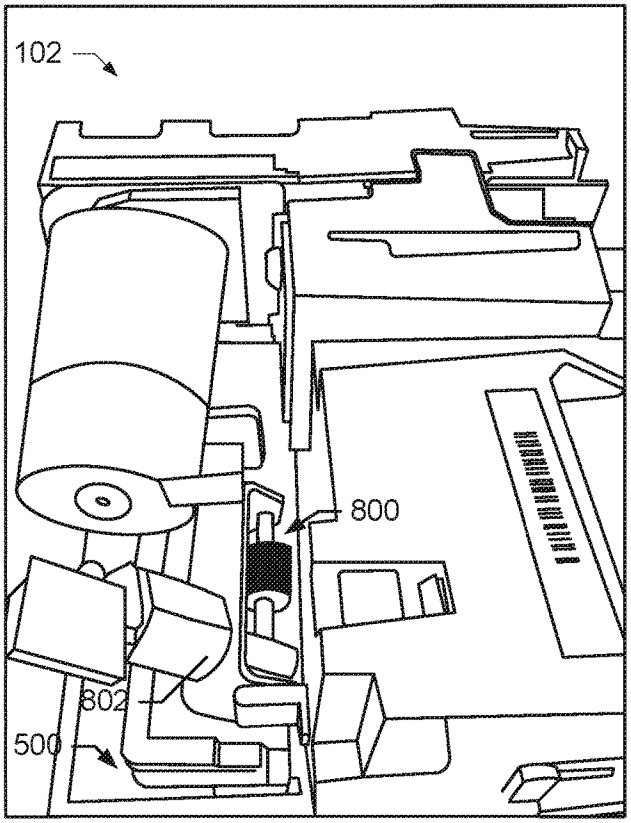
FIG. 8 is a partial, top perspective view of the example finisher of FIG. 7

FIG. 8 is a top view of a portion of the finisher 102 including the leading edge clamp 500 of FIGS. 1-7. The example leading edge clamp 500 of FIG. 8 includes a force applicator 800 coupled thereto. In the example of FIG. 8, the force applicator 800 is a roller (e.g., a roller having a substantially continuous or smooth surface). Although in FIG. 8, the force applicator 800 is located proximate to a midpoint of a length of the leading edge clamp 500, the force applicator 800 could be disposed at different a position relative to the leading edge clamp 500 (e.g., proximate to a right or left side of the leading edge clamp 500). Also, although in FIG. 8 the leading edge clamp 500 includes one force applicator 800, the leading edge clamp 500 could include other force applicators (e.g., other rollers). The example leading edge clamp 500 of FIG. 8 can include force applicators having different shapes and/or sizes than shown in FIG. 8. In the example of FIG. 8, a force applicator drive mechanism 802 (e.g., a motor) is operatively coupled to the force applicator 800. As disclosed above, the force applicator drive mechanism 802 controls rotation of the force applicator 800 based on instructions from the page registration controller 130 (FIGS. 1-5).

Figure 9:
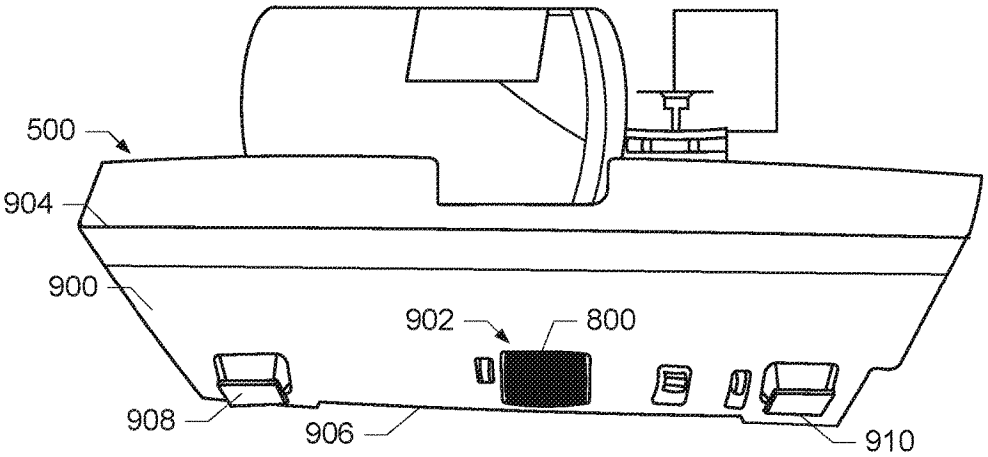
FIG. 9 is a partial, bottom perspective view of the example finisher of FIG. 7.

FIG. 9 is a bottom view of the example leading edge clamp 500 of FIG. 8. As shown in FIG. 9, the leading edge clamp 500 includes a sheet engagement surface 900 to engage a surface of a sheet (e.g., the surface 502 of the sheet 104). The sheet engagement surface 900 defines an opening 902 therein. The force applicator 800 of FIG. 8 is coupled to the leading edge clamp 500 such that a portion of the force applicator 800 protrudes through the opening 902. Thus, the opening 902 enables the force applicator 800 to contact a portion of a sheet of a stack (e.g., the sheet 104 of the stack 600) to advance or hold the sheet against the alignment guides 118, 120, 122, 124 of FIG. 1 via rotation of the force applicator 800. In some examples, the sheet engagement surface 900 of the leading edge clamp 500 serves as a ceiling to prevent or substantially reduce page buckling during contact of the force applicator 800 with the sheet.

The example leading edge clamp 500 of FIG. 9 includes a first edge 904 and a second edge 906 opposite the first edge 904. In operation, the first edge 904 is distal to the alignment guides 118, 120, 122, 124 of the finisher 102 and the second edge 906 is proximate to the alignment guides 118, 120, 122, 124. The example leading edge clamp includes a first gimbaled surface 908 and a second gimbaled surface 910. As the leading edge clamp 500 is moved to the lowered position to engage the sheet 104, the first and second gimbaled surfaces 908, 910 provide for pinching or positive clamping of the sheet 104 between the leading edge clamp 500 and the sheet stack. In some examples, the force applicator 800 (e.g., a roller) is spring-loaded so that as the leading edge clamp 500 is lowered, the force applicator 800 contacts sheet 104 and moves the sheet if needed. As the leading edge clamp 500 continued to move downward, the first and second gimbaled surface 908, 910 hard clamp the sheet to the stack.

As shown in FIG. 9, the opening 902 is defined in the sheet engagement surface 900 of the leading edge clamp 500 proximate to the second edge 906 of the leading edge clamp 500. Thus, the opening 902 is formed in the sheet engagement surface 900 so as to locate the force applicator 800 proximate to the alignment guides 118, 120, 122, 124. The positioning of the force applicator 800 proximate to the alignment guides 118, 120, 122, 124 minimizes the risk of buckling of a portion of the sheet 104 between the force applicator 800 and the surfaces 128 of the alignment guides 118, 120, 122, 124 as compared to if the force applicator 800 was located farther from the alignment guides (e.g., proximate to the first edge 904 of the leading edge clamp 500).

Figure 10:
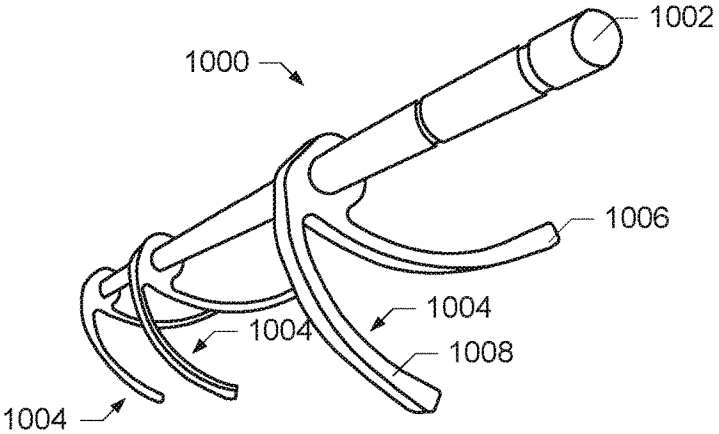
FIG. 10 is a perspective view of an example force applicator that may be used with example finishers disclosed herein.

As disclosed above, the force applicator 504, 604, 800 can include shapes other than a roller having a substantially continuous surface. FIG. 10 illustrates an example force applicator 1000 including a shaft 1002 and a plurality of projections 1004 coupled to the shaft 1002. The example force applicator 1000 can be coupled to the example leading edge clamp 500 of the finisher of FIGS. 1-9. In operation, the projections 1004 engage a sheet (e.g., the sheet 104) in the finisher 102 when the leading edge clamp 500 is in the lowered position or is being lowered. The shaft 1002 of the force applicator 1000 of FIG. 10 rotates (e.g., via the force applicator drive mechanism 506, 802). Rotation of the shaft 1002 causes the projections 1004 to exert a force on the sheet, thereby advancing the sheet against the surfaces 128 of the alignment guides 118, 120, 122, 124 of the finisher 102.

Each of the projections 1004 of the example force applicator 1000 of FIG. 10 include a first curved finger 1006 and a second curved finger 1008. The fingers 1006, 1008 advance the sheet toward the alignment guides 118, 120, 122, 124 and smoothly roll off of the sheet during rotation of the shaft 1002, and prevent instances of buckling of the sheet. The example projections 1004 can have other configurations (e.g., shapes, sizes, number of fingers) than shown in FIG. 10. Also, the number of projections 1004 and the spacing of the projections 1004 relative to one another along the shaft 1002 can differ than the example shown in FIG. 10.

Figure 12:
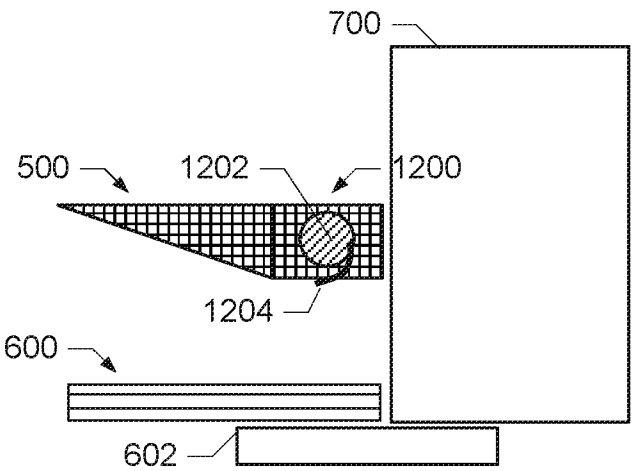
FIGS. 11-13 illustrate the example finisher of FIG. 1 and, in particular, illustrate different positions of a force applicator.
Figure 13:
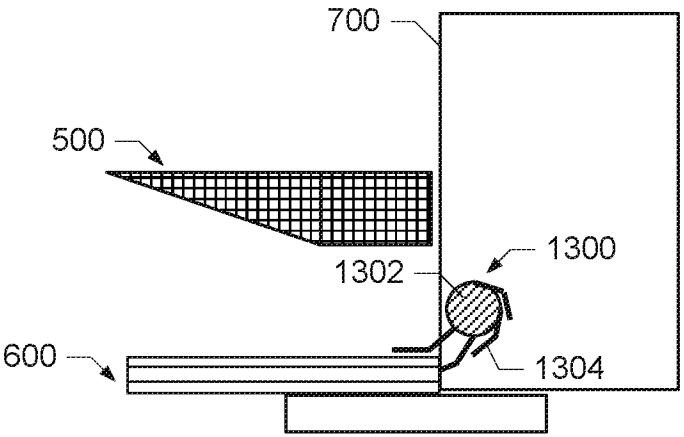
Figure 11:
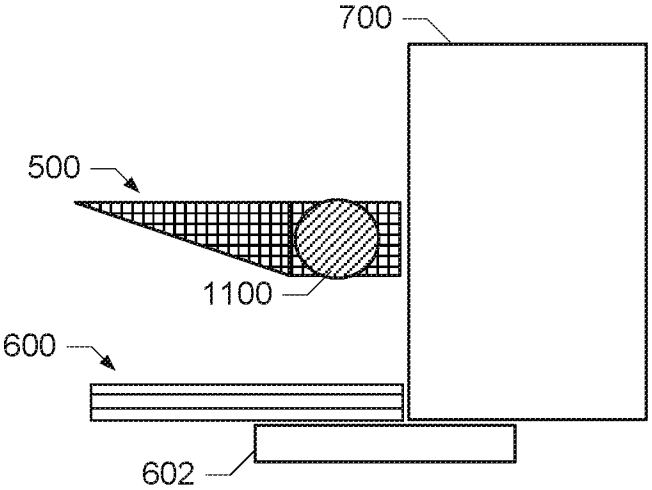

Although in the examples of FIGS. 5-9, the force applicators 504, 604, 800 are coupled to a portion of the movable leading edge clamp 500 of the finisher 102, the force applicators 504, 604, 800 could additionally or alternatively be coupled to a portion of the finisher 102 that is stationary. FIGS. 11-13 illustrate different example positions of a force applicator in the finisher 102.

In the example of FIG. 11, a force applicator 1100 is coupled to the leading edge clamp 500 substantially as disclosed above in connection with FIGS. 5-9. The leading edge clamp 500 is coupled to the housing 700 of the finisher 102. In the example of FIG. 11, the force applicator 1100 travels with the leading edge clamp 500 as the leading edge clamp 500 moves relative to the sheet stack 600 disposed on the tray 602 of the finisher 102. The force applicator 1100 of FIG. 11 can include a roller.

In the example of FIG. 12, a force applicator 1200 is coupled to the leading edge clamp 500 substantially as disclosed above in connection with FIGS. 5-9. The leading edge clamp 500 is coupled to the housing 700 of the finisher 102. In the example of FIG. 12, the force applicator 1200 travels with the leading edge clamp 500 as the leading edge clamp 500 moves relative to the sheet stack 600 disposed on the tray 602 of the finisher 102. In the example of FIG. 12, the force applicator 1200 includes a shaft 1202 and a projection 1204 coupled to and extending from the shaft 1202, substantially as disclosed above in connection with the example force applicator 1000 of FIG. 10. In some examples, the shaft 1202 includes additional projections 1204 coupled thereto.

In the example of FIG. 13, a force applicator 1300 is coupled to the housing 700 to which the leading edge clamp 500 is coupled. As shown in FIG. 13, the force applicator 1300 is spaced apart from the leading edge clamp 500. Thus, in the example of FIG. 13, the force applicator 1300 does not move with the leading edge clamp 500. Rather, the force applicator 1300 remains coupled to the stationary housing 700.

The example force applicator 1300 includes a shaft 1302 and projections 1304 coupled to and extending from the shaft 1302. In the example of FIG. 13, the projections 1304 engage a top sheet (e.g., the sheet 104) of the stack 600 to prevent or correct misalignment of the previously aligned sheets during movement of the leading edge clamp 500. The shaft 1302 of the force applicator 1300 of FIG. 13 can rotate at substantially the same time that the leading edge clamp 500 moves toward the stack 600 (e.g., based on instructions from the page registration controller 130 (FIG. 1)). Additionally or alternatively, the shaft 1302 can rotate after the leading edge clamp 500 has clamped the top sheet to the stack 600 to correct any sheet misalignment that may have occurred as the leading edge clamp 500 moves between the lowered and raised positions.

Figure 14:
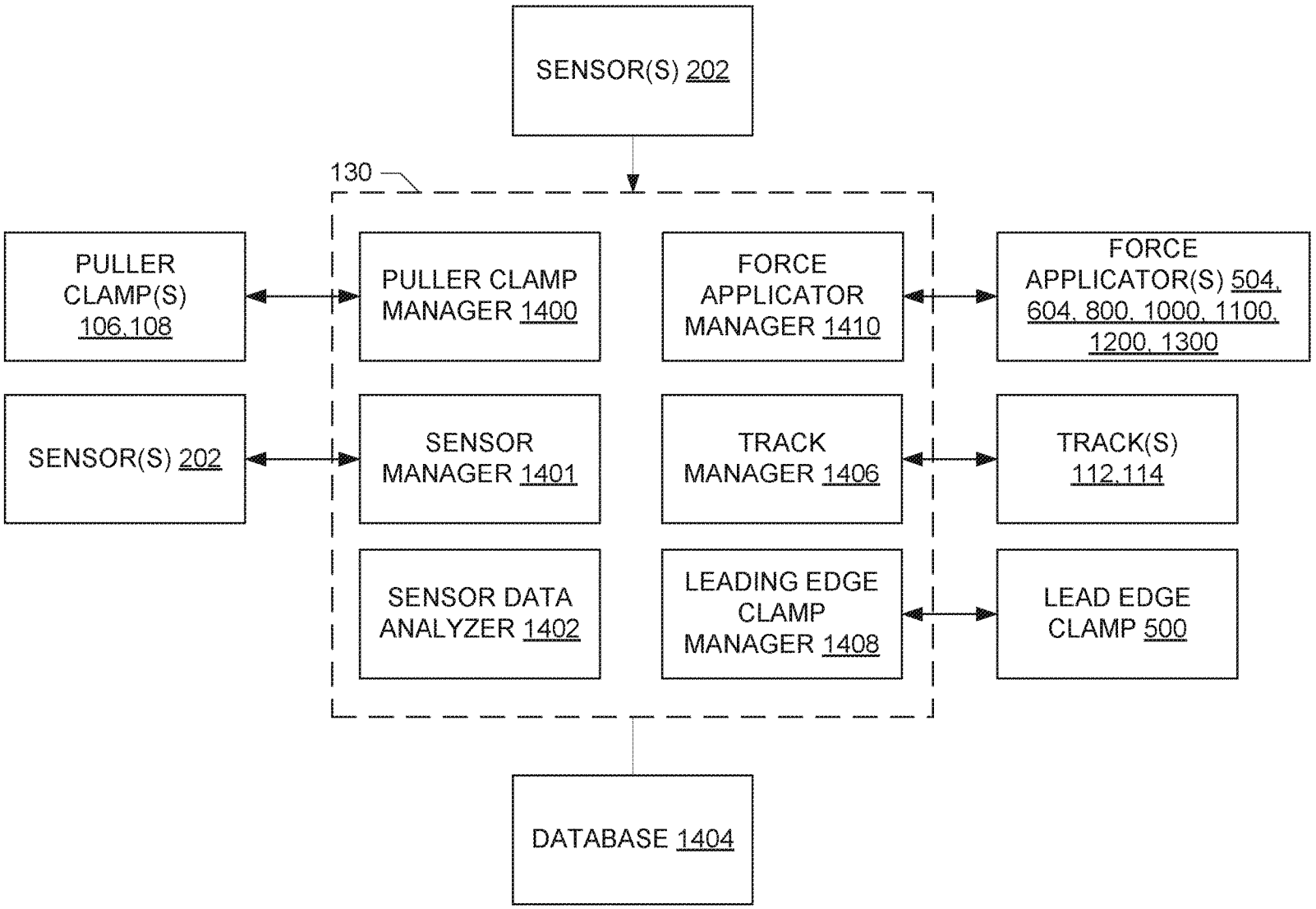
FIG. 14 is a block diagram of an example processing system for registering a sheet in a finisher that can be used to the examples disclosed herein.

FIG. 14 is a block diagram of an example implementation of the page registration controller 130 of FIGS. 1-5 that can be used to operatively control components of a finisher of a printer (e.g., the finisher 102 of FIGS. 1-9, 11-13) to register a sheet of the printer. The example page registration controller 130 of FIG. 14 includes a puller clamp manager 1400. The example puller clamp manager 1400 is communicatively coupled to the puller clamps 106, 108 of FIG. 1. The puller clamp manager 1400 controls operation of the puller clamps 106, 108 including, for example, drive mechanism of the puller clamps 106, 108 (e.g., the puller clamp drive mechanism 109 of FIG. 1). For example, the puller clamp manager 1400 controls the gripping or clamping of a sheet (e.g., the sheet 104) by the puller clamps 106, 108 when the sheet enters the finisher 102 (e.g., based on sensor data detecting a presence of the sheet and the position of the leading edge of the sheet). The puller clamp manager 1400 controls movement of the puller clamps 106, 108 along the tracks 112, 114, including, for instance, a speed at which the puller clamps 106, 108 move along the tracks 112, 114. The puller clamp manager 1400 controls release of the sheet by the puller clamps 106, 108 based on, for example, a position of the puller clamps 106, 108 along the tracks 112, 114. The puller clamp manager 1400 controls operation of the puller clamps 106, 108 based on a puller clamp operation protocol.

The example page registration controller 130 includes a sensor manager 1401. The example sensor manager 1401 is communicatively coupled to the sensor 202 of FIG. 2. The sensor manager 1401 controls operation of the sensor 202 including, for example, a drive mechanism of the sensor 202 (e.g., the sensor drive mechanism 203 of FIG. 2). For example, the sensor manger 1401 controls a power state of the sensor 202, the position and movement of the sensor 202 via the drive mechanism to detect a side edge of the sheet, etc. The sensor manager 1401 controls operation of the sensor 202 based on a sensor operation protocol.

The example page registration controller 130 includes a sensor data analyzer 1402. Sensor data generated by the sensor 202 of FIG. 2 with respect to the location of a leading edge (e.g., the leading edge 110) of the sheet in the x- and y-directions is transmitted to the page registration controller 130. The sensor data is stored in a database 1404. The database 1404 may be located at the page registration controller 130 or at a location in communication with the page registration controller 130. The sensor data analyzer 1402 of FIG. 14 analyzes the sensor data received from the sensor 202 and stored in the database 1404. Based on the analysis, the sensor data analyzer 1402 determines an amount by which the sheet should be translated in the x-direction and/or the y-direction to align the sheet with respect to previously accumulated sheets (e.g., in the stack 600) in the finisher. The sensor data analyzer 1402 can analyze the sensor data based on predefined (e.g., user defined) rules, which can be stored in the database 1404.

The example page registration controller 130 of FIG. 14 includes a track manager 1406. The track manager 1406 is communicatively coupled to the tracks 112, 114 of FIG. 1. The track manager 1406 controls operation of the tracks 112, 114 including, for example, drive mechanism of the tracks 112, 114 (e.g., the track drive mechanism 301 of FIG. 3). For example, the track manager 1406 determines a degree to which the first track 112 and/or the second track 114 should be rotated to move the sheet based on the analysis of the sensor data by the sensor data manager 1402. The track manager 1406 controls the rotation of the tracks 112, 114 and a speed at which the tracks 112, 114 are rotated. The track manager 1406 controls movement of the tracks 112, 114 based on a track operation protocol.

The example page registration controller 130 includes a leading edge clamp manager 1408. The leading edge clamp manager 1408 is communicatively coupled to the leading edge clamp 500. The leading edge clamp manager 1408 controls operation of the leading edge clamp 500 including, for example, a drive mechanism of the leading edge clamp 500 (e.g., the leading edge clamp drive mechanism 503 of FIG. 5). For example, the leading edge clamp manager 1408 instructs the leading edge clamp 500 to move toward the sheet (e.g., from the raised position to the lowered position) based on, for example, data from the puller clamp manager 1400 indicating that the puller clamps 106, 108 have released the sheet at the alignment guides 118, 120, 122, 124 of the finisher 102. In some examples, the leading edge clamp manager 1408 instructs the leading edge clamp 500 to move toward the sheet based on sensor data indicating that the sheet has contacted the surfaces 128 of the alignment guides 118, 120, 122, 124. The leading edge clamp manager 1408 controls a rate at which the leading edge clamp moves between the raised and lowered positions (e.g., via the track 702 of the housing 700 of FIG. 7) and a duration of time for which the leading edge clamp 500 engages the sheet before returning to the stored position. The leading edge clamp manager 1408 controls operation of the leading edge clamp 500 based on a leading edge clamp operation protocol.

The example page registration controller 130 includes a force applicator manager 1410. The force applicator manager 1410 is communicatively coupled to the force applicators 504, 604, 800, 1000, 1100, 1200, 1300 of FIGS. 5-13. The force applicator manager 1410 controls operation of the force applicators 504, 604, 800, 1000, 1100, 1200, 1300, including, for example, a drive mechanism of the force applicators (e.g., the force applicator drive mechanism 506, 802 of FIGS. 5, 8). For example, the force applicator manager 1410 controls a time at which the force applicators 504, 604, 800, 1000, 1100, 1200, 1300 are activated (e.g., to rotate). The timing of the activation of the force applicators 504, 604, 800, 1000, 1100, 1200, 1300 can be based on a position of the leading edge clamp 500 as determined by the leading edge clamp manager 1408. The force applicator manager 1410 controls a speed at which the force applicators 504, 604, 800, 1000, 1100, 1200, 1300 move (e.g., a speed of rotation) and duration of time which the force applicators 504, 604, 800, 1000, 1100, 1200, 1300 are activated. In some examples, the speed of the force applicators 504, 604, 800, 1000, 1100, 1200, 1300 and/or the duration of time for which the force applicators 504, 604, 800, 1000, 1100, 1200, 1300 are active are based on a speed at which the leading edge clamp 500 moves. The force applicator manager 1410 controls operation of the force applicators 504, 604, 800, 1000, 1100, 1200, 1300 based on a force applicator operation protocol.

In some examples, operational variables of the force applicators 504, 604, 800, 1000, 1100, 1200, 1300 are based on an ink content of the sheet. For example, the force applicator manager 1410 can infer an amount of ink on the sheet based on an amount of time for the sheet to be delivered to the finisher 102 (which can communicated to the page registration controller 130 from other controllers of a printer having the finisher 102). Based on the determination or estimation of the amount of ink on the sheet, the force applicator manager 1410 can determine a timing of activation, a duration of activation, and/or a speed of activation for the force applicators 504, 604, 800, 1000, 1100, 1200, 1300 to ensure the integrity of the printed sheet (e.g., prevent smearing).

In some examples, the leading edge clamp manager 1408 instructs the leading edge clamp 500 to remain in the lowered position until another sheet is received in the finisher for accumulation with the stack. In such examples, the force applicator manager 1410 instructs the force applicators 504, 604, 800, 1000, 1100, 1200, 1300 to remain active and/or in contact with the sheet 104 until the next sheet is added to the stack. The contact of the force applicators 504, 604, 800, 1000, 1100, 1200, 1300 with the sheet 104 until the next sheet is added helps ensure that the sheet 104 will remain aligned during operation of the finisher 102.

While an example manner of implementing the page registration controller 130 of FIGS. 1-5 is illustrated in FIG. 14, the elements, processes and/or devices illustrated in FIG. 14 may be combined, divided, re-arranged, omitted, eliminated and/or implemented in any other way. Further, the example puller clamp manager 1400, the example sensor data analyzer 1402, the example database 1404, the example track manager 1406, the example leading edge clamp manager 1408, the example force applicator 1410, and/or, more generally, the example page registration controller 130 of FIG. 14 may be implemented by hardware, software, firmware and/or any combination of hardware, software and/or firmware. Thus, for example, any of the example puller clamp manager 1400, the example sensor data analyzer 1402, the example database 1404, the example track manager 1406, the example leading edge clamp manager 1408, the example force applicator 1410, and/or, more generally, the example page registration controller 130 of FIG. 14 could be implemented by analog or digital circuits, logic circuits, programmable processors, programmable controllers, graphics processing units (GPUs), digital signal processors (DSPs), application specific integrated circuits (ASICs), programmable logic devices (PLDs) and/or field programmable logic devices (FPLDs). When reading any of the apparatus or system claims of this patent to cover a purely software and/or firmware implementation, the example puller clamp manager 1400, the example sensor data analyzer 1402, the example database 1404, the example track manager 1406, the example leading edge clamp manager 1408, the example force applicator 1410, and/or, more generally, the example page registration controller 130 of FIG. 14 is/are hereby expressly defined to include a non-transitory computer readable storage device or storage disk such as a memory, a digital versatile disk (DVD), a compact disk (CD), a Blu-ray disk, etc. including the software and/or firmware. Further still, the example page registration controller 130 of FIG. 14 may include elements, processes and/or devices in addition to, or instead of, those illustrated in FIG. 14, and/or may include more than one of any or all of the illustrated elements, processes and devices. As used herein, the phrase "in communication," including variations thereof, encompasses direct communication and/or indirect communication through intermediary components, and does not have to include direct physical (e.g., wired) communication and/or constant communication, but rather additionally includes selective communication at periodic intervals, scheduled intervals, aperiodic intervals, and/or one-time events.

Figure 15:
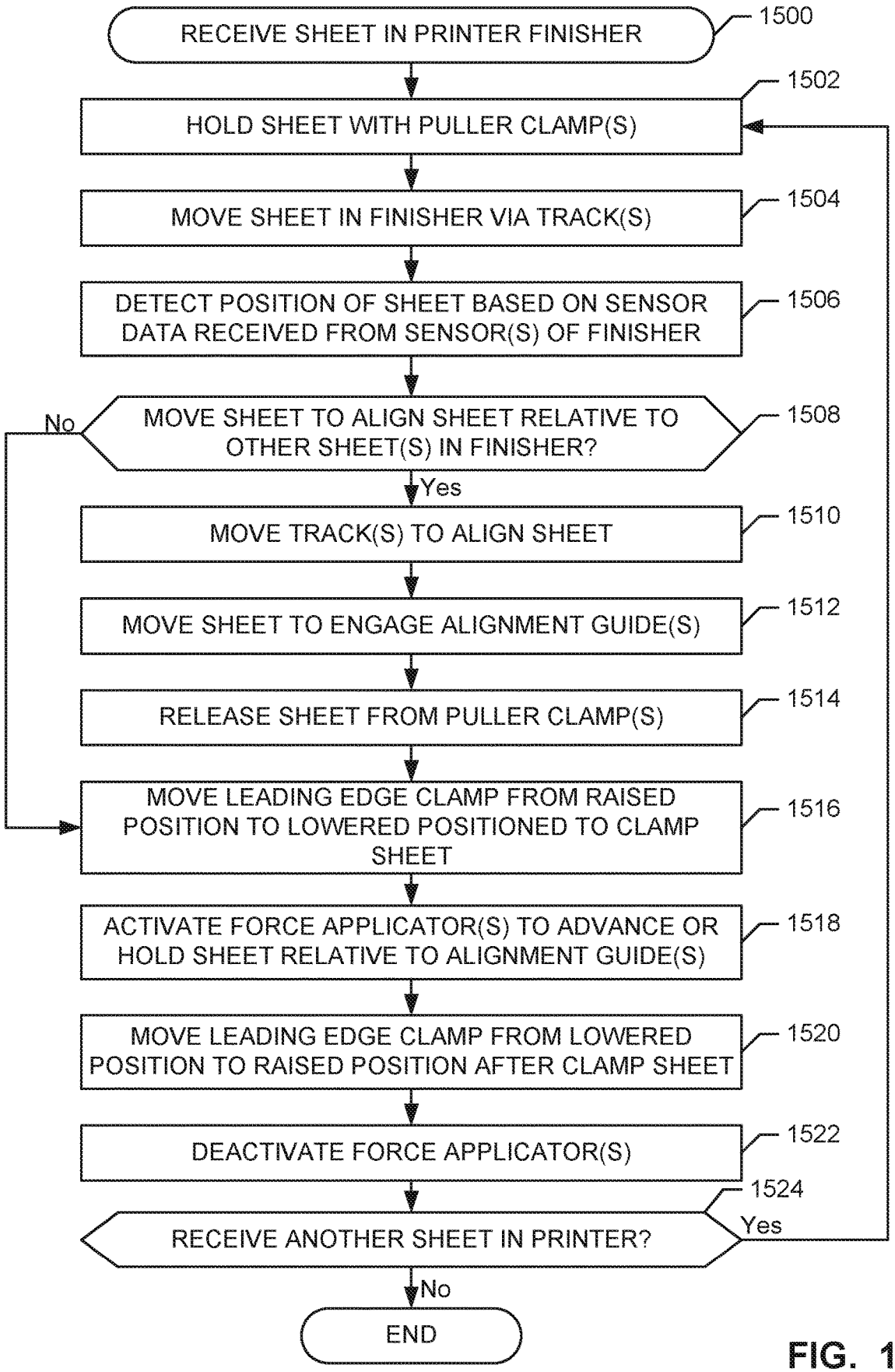
FIG. 15 is a flowchart representative of machine readable instructions that may be executed to implement the example finishers of FIGS. 1-9 and 11-13.

A flowchart representative of example hardware logic, machine readable instructions, hardware implemented state machines, and/or any combination thereof for implementing the page registration controller 130 of FIG. 14 is shown in FIG. 15. The machine readable instructions may be an executable program or portion of an executable program for execution by a computer processor such as the processor 1612 shown in the example processor platform 1600 discussed below in connection with FIG. 16. The program may be embodied in software stored on a non-transitory computer readable storage medium such as a CD-ROM, a floppy disk, a hard drive, a DVD, a Blu-ray disk, or a memory associated with the processor 1612, but the entire program and/or parts thereof could alternatively be executed by a device other than the processor 1612 and/or embodied in firmware or dedicated hardware. Further, although the example program is described with reference to the flowchart illustrated in FIG. 16, many other methods of implementing the example page registration controller 130 may alternatively be used. For example, the order of execution of the blocks may be changed, and/or some of the blocks described may be changed, eliminated, or combined. Additionally or alternatively, any or all of the blocks may be implemented by hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example processes of FIG. 15 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, the term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C.

FIG. 15 is a flowchart representative of example machine readable instructions that may be executed by the page registration controller 130 of FIG. 14 to align a sheet (e.g., the sheet 104 of FIGS. 1-6) with previously accumulated sheets (e.g., the stack 600 of FIG. 6) in a finisher (e.g., the finisher 102 of FIGS. 1-8) of a printer. The example instructions of FIG. 15 begin when a sheet is received in the finisher 102 (block 1500).

In the example of FIG. 15, the puller clamp manager 1400 of the page registration controller 130 instructs the puller clamps 106, 108 of the finisher 102 to hold the sheet 104 (block 1502). The puller clamps 106, 108 hold (e.g., pinch, clasp, grasp) a portion of the sheet 104 such as the leading edge 110 of the sheet 104. The page registration controller 130 instructs the puller clamps 106, 108 to move the sheet 104 along the tracks 112, 114 of the finisher 102 for alignment with the previously accumulated sheets in the finisher 102 (block 1504). In the example of FIG. 15, the puller clamp manager 1400 controls operation of the puller clamps 106, 108 via the puller clamp drive mechanisms 109 of FIG. 1.

In the example of FIG. 15, the sensor data analyzer 1402 of the page registration controller 130 detects a position of the sheet 104 relative to previously accumulated sheets in the finisher 102 (e.g., sheets of the stack 600 of FIG. 6) based on sensor data received from the sensor 202 (block 1506). The sensor data is stored in the database 1404 associated with the page registration controller 130. The sensor data analyzer 1402 detects or locates the leading edge 110 of the sheet 104 in the x- and y-directions based on the sensor data.

Based on the analysis, the sensor data analyzer 1402 determines if the sheet 104 should be moved in the finisher 102 to align the sheet 104 with the previously accumulated sheets (block 1508). If the sheet 104 is to be moved, the track manager 1406 instructs the tracks 112, 114 to move (e.g., rotate, pivot, translate) to translate the sheet in the x-direction and/or the y-direction (block 1510). The track manager 1406 controls operation of the tracks 112, 114 via the track drive mechanism 301 of FIG. 3. In the example of FIG. 15, the track manager 1406 instructs the tracks 112, 114 to move a certain amount (e.g., a particular degree, a particular linear distance) based on the sheet position data analyzed by the sensor data analyzer 1402.

In the example of FIG. 15, the puller clamp manager 1400 instructs the puller clamps 106, 108 to move the sheet into engagement with the alignment guides 118, 120, 122, 124 of the finisher 102 (block 1512). The puller clamp manager 1400 instructs the puller clamps 106, 108 to pull the sheet 104 along the (e.g., rotated) tracks until the leading edge 110 of the sheet 104 engages respective surfaces 128 of the alignment guides 118, 120, 122, 124. In the example of FIG. 15, the puller clamp manager 1400 instructs the puller clamps 106, 108 to release the sheet 104 when the sheet 104 contacts the alignment guides 118, 120, 122, 124 (block 1514).

In the example of FIG. 15, the leading edge clamp manager 1408 of the page registration controller 130 moves the leading edge clamp 500 from a raised position relative to the sheet 104 in the finisher 102 to a lowered position to clamp the sheet 104 to the previously accumulated sheets (block 1516). The leading edge clamp manager 1408 controls movement of the leading edge clamp 500 along the tracks 702 of the housing 700 via the leading edge clamp drive mechanisms 503 of FIG. 5. In the lowered position, the leading edge clamp 500 engages the sheet 104 to clamp the sheet to the previously accumulated sheets.

In the example of FIG. 15, the force applicator manager 1410 of the page registration controller 130 activates the force applicators 504, 604, 800, 1000, 1100, 1200, 1300 to move or hold the sheet 104 relative to the alignment guides 118, 120, 122, 124 (block 1518). Activation of the force applicators 504, 604, 800, 1000, 1100, 1200, 1300 can include causing the force applicators 504, 604, 800, 1000, 1100, 1200, 1300 to rotate. In the example of FIG. 15, the force applicator manager 1410 activates the force applicators 504, 604, 800, 1000, 1100, 1200, 1300 based on, for example, the position of the leading edge clamp 500 relative to the sheet 104. In some examples, the force applicator manager 1410 instructs the force applicators 504, 604, 800, 1000, 1100, 1200, 1300 to be activated (e.g., rotate) before the leading edge clamp 500 is lowered or while the leading edge clamp is being lowered. The force applicators 504, 604, 800, 1000, 1100, 1200, 1300 engage a portion of the sheet 104 (e.g., the sheet surface 502) to advance or hold the sheet 104 against the alignment guides 118, 120, 122, 124 to prevent or correct any misalignment that may occur during movement of the leading edge clamp 500 and/or engagement of the leading edge clamp 500 with the sheet 104. The force applicator manager 1410 controls operation of the force applicators 504, 604, 800, 1000, 1100, 1200, 1300 via the force applicator drive mechanism 802 of FIG. 8. The force applicator manager 1410 controls operation of the force applicators 504, 604, 800, 1000, 1100, 1200, 1300 based on predefined rules with respect to, for instance, a speed at which the force applicators 504, 604, 800, 1000, 1100, 1200, 1300 rotate, a duration of time the force applicators 504, 604, 800, 1000, 1100, 1200, 1300 are active, etc.

In the example of FIG. 15, the leading edge clamp manager 1408 instructs the leading edge clamp 500 to move from the lowered position to the raised position after clamping the sheet 104 to the previously accumulated sheets in the finisher 102 (block 1520). In some examples, the force applicators 504, 604, 800, 1000, 1100, 1200, 1300 are deactivated before the leading edge clamp 500 moves to the raised position. In the example of FIG. 15, the force applicator manager 1410 deactivates the force applicators 504, 604, 800, 1000, 1100, 1200, 1300 at some time after the leading edge clamp 500 moves to the raised position (block 1522). The force applicator manager 1410 determines when the force applicators 504, 604, 800, 1000, 1100, 1200, 1300 are to be deactivated based on predefined rules. For example, if the force applicators 504, 604, 800, 1000, 1100, 1200, 1300 are coupled to the leading edge clamp, the force applicator manager deactivates the force applicators 504, 604, 800, 1000, 1100, 1200, 1300 when the leading edge clamp 500 moves from the lowered position to the raised position. As another example, if the force applicators 504, 604, 800, 1000, 1100, 1200, 1300 are coupled to the housing 700 of the finisher 102, the force applicator manager 1410 deactivates the force applicators 504, 604, 800, 1000, 1100, 1200, 1300 at some time after the leading edge clamp 500 returns to the raised position. In other examples, the force applicators 504, 604, 800, 1000, 1100, 1200, 1300 remain active and/or maintain contact with the sheet 104 until another sheet is accumulated in the stack 600.

The example instructions of FIG. 15 continued until no other sheets are received at the finisher 102 (block 1524).

Figure 16:
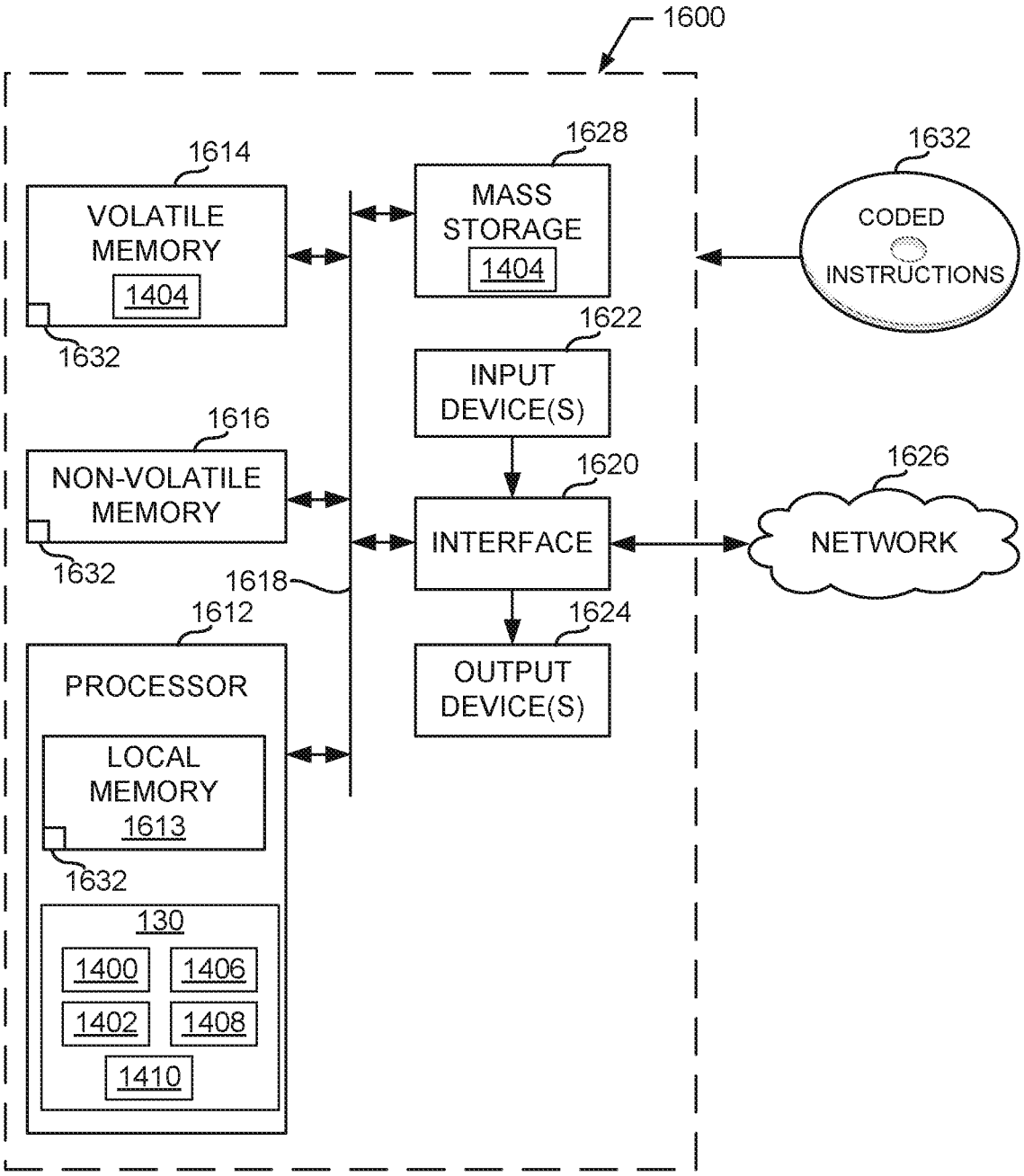
FIG. 16 is a processor platform that may execute the example instructions of FIG. 15 to implement the example processing system of FIG. 14.

FIG. 16 is a block diagram of an example processor platform 1600 structured to execute the instructions of FIG. 15 to implement the page registration controller 130 of FIG. 14. The processor platform 1600 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, or any other type of computing device.

The processor platform 1600 of the illustrated example includes a processor 1612. The processor 1612 of the illustrated example is hardware. For example, the processor 1612 can be implemented by integrated circuits, logic circuits, microprocessors, GPUs, DSPs, or controllers from any desired family or manufacturer. The hardware processor may be a semiconductor based (e.g., silicon based) device. In this example, the processor implements the example page registration controller 130 including the example puller clamp manager 1400, the example sensor data analyzer 1402, the example database 1404, the example track manager 1406, the example leading edge clamp manager 1408, and the example force applicator manager 1410.

The processor 1612 of the illustrated example includes a local memory 1613 (e.g., a cache). The processor 1612 of the illustrated example is in communication with a main memory including a volatile memory 1614 and a non-volatile memory 1616 via a bus 1618. The volatile memory 1614 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1616 may be implemented by flash memory and/or any other desired type of memory device. Access to the main memory 1614, 1616 is controlled by a memory controller.

The processor platform 1600 of the illustrated example also includes an interface circuit 1620. The interface circuit 1620 may be implemented by any type of interface standard, such as an Ethernet interface, a universal serial bus (USB), a Bluetooth® interface, a near field communication (NFC) interface, and/or a PCI express interface.

In the illustrated example, input devices 1622 are connected to the interface circuit 1620. The input devices 1622 permit a user to enter data and/or commands into the processor 1612. The input devices can be implemented by, for example, an audio sensor, a microphone, a camera (still or video), a keyboard, a button, a mouse, a touchscreen, a track-pad, a trackball, isopoint and/or a voice recognition system.

Output devices 1624 are also connected to the interface circuit 1620 of the illustrated example. The output devices 1624 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 1620 of the illustrated example, thus, typically includes a graphics driver card, a graphics driver chip and/or a graphics driver processor.

The interface circuit 1620 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1626. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1600 of the illustrated example also includes mass storage devices 1628 for storing software and/or data. Examples of such mass storage devices 1628 include floppy disk drives, hard drive disks, compact disk drives, Blu-ray disk drives, redundant array of independent disks (RAID) systems, and digital versatile disk (DVD) drives.

The machine executable instructions 1632 of FIG. 16 may be stored in the mass storage device 1628, in the volatile memory 1614, in the non-volatile memory 1616, and/or on a removable non-transitory computer readable storage medium such as a CD or DVD.

From the foregoing, it will be appreciated that example apparatus, methods, and articles of manufacture have been disclosed to register a sheet in a finisher of a printer relative to previously accumulated sheets in the finisher for finishing operations such as stapling and/or booklet making. Some examples disclosed herein include a two-stage registration process to align the sheet and to remove any residual misalignment that can occur when a sheet clamp clamps the sheet to the previously accumulated sheets after the sheet has been initially aligned. In examples disclosed herein, the finisher includes a force applicators coupled to, for instance, a sheet clamp and/or a housing of the finisher. The force applicators exerts a force on the sheet to advance or hold the sheet against alignment guides of the finisher to prevent or correct any misalignment that may occur during movement of the sheet clamp. Examples disclosed herein provide for improved accuracy in alignment of a sheet and improved printer job quality.

An example printer disclosed herein includes an alignment guide, a track to align a sheet relative to the alignment guide, a clamp to move between a raised position and a lowered position relative to the sheet, and a force applicator coupled to the clamp. The force applicator is to cause the sheet to engage the alignment guide when the clamp is in the lowered position.

In some examples, the force applicator is a roller. In some such examples, the roller is a first roller and the printer further includes a second roller coupled to the clamp, the second roller spaced apart from the first roller.

In some examples, the force applicator includes a shaft and a plurality of projections coupled to the shaft.

In some examples, a surface of the clamp defines an opening therein. In such examples, a portion of the force applicator to extend through the opening.

In some examples, the clamp includes a first edge proximate to the alignment guide and a second edge distal to the alignment guide. In such examples, the force applicator coupled to the clamp proximate to the first edge.

In some examples, the track is to align the sheet relative to the alignment guide prior to the clamp moving to the lowered position.

An example apparatus disclosed herein includes an alignment guide to align an edge of a sheet received in a printer. The example apparatus includes a clamp to move between a raised position and a lowered position relative to the sheet. The clamp is to contact a surface of the sheet in the lowered position. The example apparatus includes a force applicator and a processor operatively coupled to the clamp and the force applicator. The processor is to cause the force applicator to engage the sheet when the clamp moves between the raised position and the lowered position to one of hold or move the edge of the sheet in contact with the alignment guide.

In some examples, the force applicator is coupled to the clamp.

In some examples, the apparatus further includes a housing. In such examples, the clamp is moveably coupled to the housing. Also, in such examples, the force applicator is coupled to the housing spaced apart from the clamp. In some such examples, the force applicator includes a plurality of fingers to engage the sheet.

In some examples, the processor is to control the force applicator based on a position of the clamp.

In some examples, the clamp is a first clamp and the apparatus further includes a second clamp. In such examples, the processor is to cause the second clamp to move the edge of the sheet in contact with the alignment guide at a first time and cause the force applicator to hold or move the edge of the sheet in contact with the alignment guide at a second time after the first time.

In some examples, the processor is to cause the force applicator to rotate in a direction toward the alignment guide.

An example apparatus for finishing a plurality of sheets in a printer disclosed herein includes an alignment guide, a track, a first clamp to move a first sheet via the track to engage the alignment guide, a second clamp to clamp the first sheet to the plurality of sheets, and a force applicator to exert a force on a surface of the first sheet in response to the clamping of the first sheet by the second clamp. The force applicator is to maintain or re-engage the sheet with the alignment guide.

In some examples, the force applicator includes a roller and the apparatus further includes a processor operatively coupled to the roller. The processor is to control a rotational speed of the roller.

In some examples, the force applicator is coupled to the second clamp.

In some examples, the apparatus further includes a housing. In such examples, the second clamp is movable coupled to the housing. Also, in such examples, the force applicator is coupled to the housing.

In some examples, the force applicator is to exert the force on the first sheet for a period of time until a second sheet is received at the track.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A printer comprising:

an alignment guide;

a track to align a sheet relative to the alignment guide;

a puller clamp to move the sheet via the track to engage the alignment guide;

a leading edge clamp to move between a raised position and a lowered position relative to the sheet, the leading edge clamp to contact a surface of the sheet when in the lowered position; and a force applicator coupled to the leading edge clamp, the force applicator to cause the sheet to engage the alignment guide when the leading edge clamp is in the lowered position.

2. The printer of claim 1, wherein the force applicator is a roller.

3. The printer of claim 2, wherein the roller is a first roller and further including a second roller coupled to the leading edge clamp, the second roller spaced apart from the first roller.

4. The printer of claim 1, wherein the force applicator includes a shaft and a plurality of projections coupled to the shaft.

5. The printer of claim 1, wherein a surface of the leading edge clamp defines an opening therein, a portion of the force applicator to extend through the opening.

6. An apparatus comprising:

an alignment guide at an end of a track to align an edge of a sheet received in a printer;

a puller clamp to move the sheet along the track;

a leading edge clamp to move between a raised position and a lowered position relative to the sheet, the leading edge clamp to contact a surface of the sheet in the lowered position;

a force applicator; and a processor operatively coupled to the puller clamp, the leading edge clamp and the force applicator, the processor to cause the track to align the sheet relative to the alignment guide as the puller clamp moves the sheet along the track, and the processor to cause the force applicator to engage the sheet when the leading edge clamp moves between the raised position and the lowered position to one of hold or move the edge of the sheet in contact with the alignment guide.

7. The apparatus of claim 6, wherein the force applicator is coupled to the leading edge clamp.

8. The apparatus of claim 6, further including a housing, the leading edge clamp moveably coupled to the housing and wherein the force applicator is coupled to the housing spaced apart from the leading edge clamp.

9. The apparatus of claim 6, wherein the processor is to control the force applicator based on a position of the leading edge clamp.

10. The apparatus of claim 6, the processor to:

cause the puller clamp to move the edge of the sheet in contact with the alignment guide at a first time; and cause the force applicator to hold or move the edge of the sheet in contact with the alignment guide at a second time after the first time.

11. The apparatus of claim 6, wherein the processor is to cause the force applicator to rotate in a direction toward the alignment guide.

12. An apparatus for finishing a plurality of sheets in a printer, the apparatus comprising:

an alignment guide;

a track to align a first sheet of the plurality of sheets relative to the alignment guide;

a first clamp to move the first sheet via the track to engage the alignment guide;

a second clamp to be lowered to clamp the first sheet to the plurality of sheets; and a force applicator to exert a force on a surface of the first sheet in response to the clamping of the first sheet by the second clamp to maintain or re-engage the first sheet with the alignment guide.

13. The apparatus of claim 12, wherein the force applicator includes a roller and further including a processor operatively coupled to the roller, the processor to control a rotational speed of the roller.

14. The apparatus of claim 12, wherein the force applicator is coupled to the second clamp.

15. The apparatus of claim 12, wherein the force applicator is to exert the force on the first sheet for a period of time until a second sheet is received at the track.

* * * * *